US009220321B1

(12) United States Patent
Sun et al.

(10) Patent No.: US 9,220,321 B1
(45) Date of Patent: Dec. 29, 2015

(54) BUTTON DEVICE

(71) Applicant: NATIONAL CENTRAL UNIVERSITY, Taoyuan County (TW)

(72) Inventors: Ching-Cherng Sun, Taoyuan County (TW); Chiu-Fen Wang, Taoyuan County (TW); Yeh-Wei Yu, Taoyuan County (TW)

(73) Assignee: National Central University, Taoyuan County (TW)

( * ) Notice: Subject to any disclaimer, the term of this patent is extended or adjusted under 35 U.S.C. 154(b) by 0 days.

(21) Appl. No.: 14/325,494

(22) Filed: Jul. 8, 2014

(51) Int. Cl.

| | |
|---|---|
| ***A44B 1/04*** | (2006.01) |
| ***A44B 1/38*** | (2006.01) |
| ***A44B 1/14*** | (2006.01) |
| *G06K 7/10* | (2006.01) |

(52) U.S. Cl.
CPC ... *A44B 1/04* (2013.01); *A44B 1/14* (2013.01); *A44B 1/38* (2013.01)

(58) Field of Classification Search
CPC ..... A44B 1/123; A41D 27/085; G09F 2021/023; G09F 3/207
USPC ..... 235/462.44
See application file for complete search history.

(56) References Cited

U.S. PATENT DOCUMENTS

| | | | | |
|---|---|---|---|---|
| 5,048,160 | A * | 9/1991 | Goodrich et al. | 24/306 |
| 6,378,174 | B1 * | 4/2002 | Wong | 24/303 |
| 8,631,517 | B1 * | 1/2014 | Blakely | 2/266 |
| 8,938,861 | B1 * | 1/2015 | McLendon | 24/103 |
| 2004/0088832 | A1 * | 5/2004 | Groves | 24/90.1 |
| 2005/0177985 | A1 * | 8/2005 | Sjoquist | 24/104 |
| 2006/0192642 | A1 * | 8/2006 | Ruiz et al. | 335/207 |
| 2006/0236509 | A1 * | 10/2006 | Ausman | 24/303 |
| 2006/0265841 | A1 * | 11/2006 | Abadi | 24/303 |
| 2011/0277502 | A1 * | 11/2011 | Welikson | 63/1.18 |
| 2012/0020032 | A1 * | 1/2012 | Huang et al. | 361/748 |
| 2012/0042480 | A1 * | 2/2012 | Ingels | 24/103 |
| 2015/0170480 | A1 * | 6/2015 | Chen et al. | 362/103 |

FOREIGN PATENT DOCUMENTS

GB 2485425 A * 5/2012

* cited by examiner

*Primary Examiner* — Thien M Le
*Assistant Examiner* — Claude J Brown
(74) *Attorney, Agent, or Firm* — Rosenberg, Klein & Lee

(57) ABSTRACT

The invention relates to a button device, attachable to the clothing, comprising: a main grip body, having a clip member for attaching to the clothing; and a subsidiary grip body, attaching to the clothing and being buckled with the main grip body, where the position of the subsidiary grip body on the clothing is in the same height to that of the main grip body. The subsidiary grip body is provided with a coupling member corresponding to the joint member for mutual engagement, and is provided with a latch member for attaching to the clothing. Accordingly, once the main grip body and the subsidiary grip body are attached to the clothing, and the joint member and the coupling member are engaged one with the other, the dressing is then aesthetic and the new button device is functional, which saves time and efforts for the replacement.

8 Claims, 7 Drawing Sheets

BUTTON DEVICE

BACKGROUND OF THE INVENTION

1. Field of the Invention

The present invention relates to a button device, and especially applying to garments of all kinds with buttons, where the button device features the replacement of the lost button with an electronic type of button having a display to simulate the appearance of the lost button and to make the dressing neat.

2. Description of Related Art

As shown in FIG. 9, a shirt 7, a garment for the upper part of the body, often comes with a front opening 73, collar, and sleeves 71, aside from its body portion 72. And one side of the front opening 73 is set with spaced buttons 8 while the other side corresponding to the button 8 is provided with plural spaced buckle opening 81 correspondingly. Users only need to cross one arm from the front opening 73 into one sleeve 71, wear on the body portion 72, and finish the other sleeve 71, followed by engaging each button 8 with the corresponding buckle opening 81, and the shirt is worn on the body.

Most of the buttons are sewn on the clothing by needlework which is vulnerable to be pulled off by external forces. Besides, the buttons always belong to small items, which are not easy to be found once lost, and that would cause the dressed person looked untidy and also offend aesthetic sensibility of others. Shirts always have spare buttons sewn on the inner side or bottom corner. But once someone is out of home and does not carry the sewing kit, that is, no spare buttons for backup, which would make someone embarrassed in the public places.

In view of the foregoing circumstances, the inventor has invested much time to study the relevant knowledge. After quite many experiments and improvement, the button device of this invention is eventually succeeded, substantially settles the aforesaid embarrassment and also meets the urgent use.

SUMMARY OF THE INVENTION

The primary objective of the present invention is to provide a user, who lost loose buttons of clothing, a device similar to the original button to simulate the original style, thereby making the overall look neat and no excessive exposure, which improves the aforesaid drawbacks for clothing having buttons. Accordingly, the present inventors strive to achieve the purpose and function of this invention. A button device of this invention, is available to be attached to clothing, comprising: a main grip body, having a clip member at its one side, where the clip member connects to the main grip body at its one end while the other end is elastically buckled away from or close to the main grip body. And the clip member is provided with a joint member on the outer side of the other end without connecting to the main grip body; and a subsidiary grip body, attaching to the clothing and being buckled with the main grip body, where the position of the subsidiary grip body on the clothing is in the same height to that of the main grip body. The subsidiary grip body is provided with a coupling member corresponding to the joint member for mutual engagement, and is provided with a latch member on the side opposite to the side with the coupling member, where the latch member connects to the subsidiary grip body at its one end while the other end is elastically buckled away from or close to the main grip body. Accordingly, once the main grip body and the subsidiary grip body are attached to the clothing, and the joint member and the coupling member are engaged one with the other, the dressing is then aesthetic and the new button device is functional, which saves time and efforts for the replacement.

A further technical traits of the present invention lies in that the main grip body is provided with a display mounting on its outer side, where the display and the clip member are located in opposite side of the main grip body, and the main grip body has a built-in database electrically connected to the display. And the main grip body has a power supply electrically connected with the display. The database is provided with information of plural button patterns, where the display shows the information and corresponding button patterns.

The present invention is further characterized in that the subsidiary grip body is provided with a power member, and the joint member and the coupling member are realized as positive and negative electrodes respectively accompanied by the setup of the power member. By way of the electrical coupling for the joint member of the clip member and the coupling member of the subsidiary grip body, electric power is available to be transmitted for use by the display.

The present invention is further characterized in that the main grip body is provided with an input member adjacent to one side of the display, and the input member is a camera featuring images taking. The input member is electrically connected to the database, takes shots of the button patterns and stores them in the database for later use.

The present invention is further characterized in that the input member is available to be a microphone or a CMOS integrated circuit for setting purpose.

The present invention is further characterized in that the main grip body is provided with a backlight member electrically connected to a power supply member near a side of the display, the backlight is a LED or an OLED, and the backlight member is for illuminating and enhancing the button patterns shown by the display.

The present invention is further characterized in that the joint member and the coupling member are realized as positive and negative electrodes respectively and connected one with the other, and electric power is available to be transmitted for use by the backlight member.

The present invention is further characterized in that the joint member and the coupling member are magnets that one attracts the other, Velcro (hook-and-loop fasteners) or male and female buckles.

The present invention is further characterized in that the clip member and the latch member are L-shape resilient clamp, magnet, crochet, paper clips, clips or earrings.

The various objectives and advantages of the present invention will be more readily understood from the following detailed description when read in conjunction with the appended drawing.

DETAILED DESCRIPTION OF THE INVENTION

Figure 1:
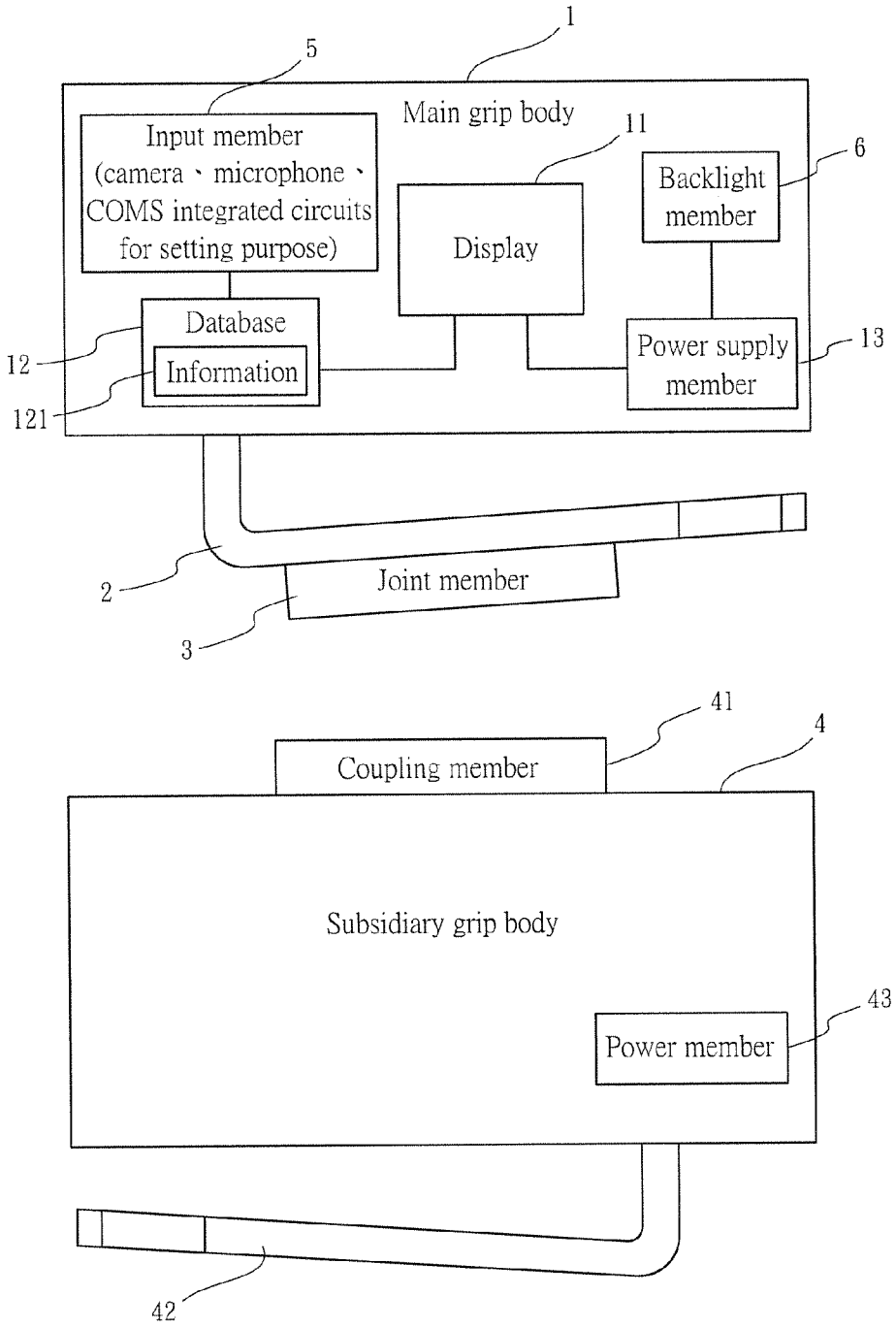
FIG. 1 is a block diagram of a preferred embodiment of the present invention.
Figure 2:
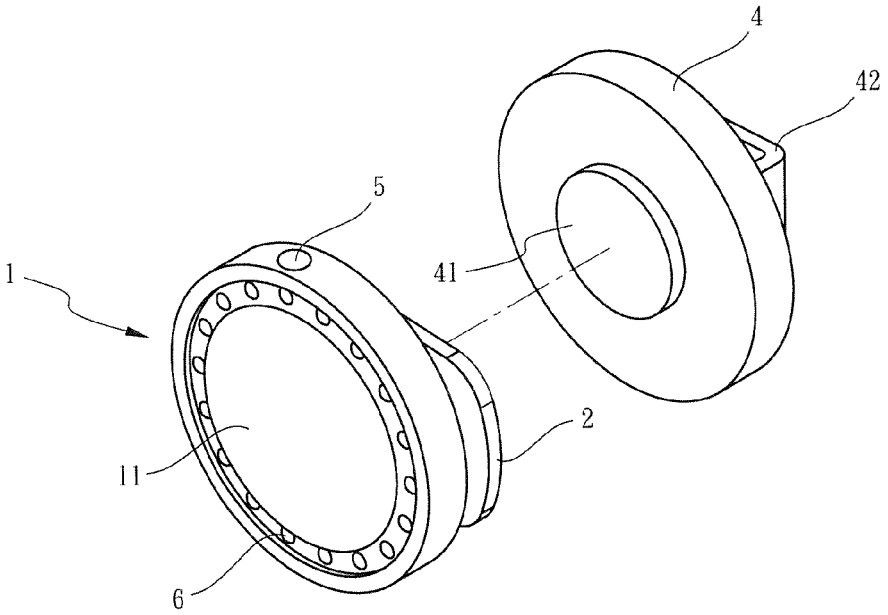
FIG. 2 is a three-dimensional exploded diagram of a preferred embodiment of the present invention.
Figure 3:
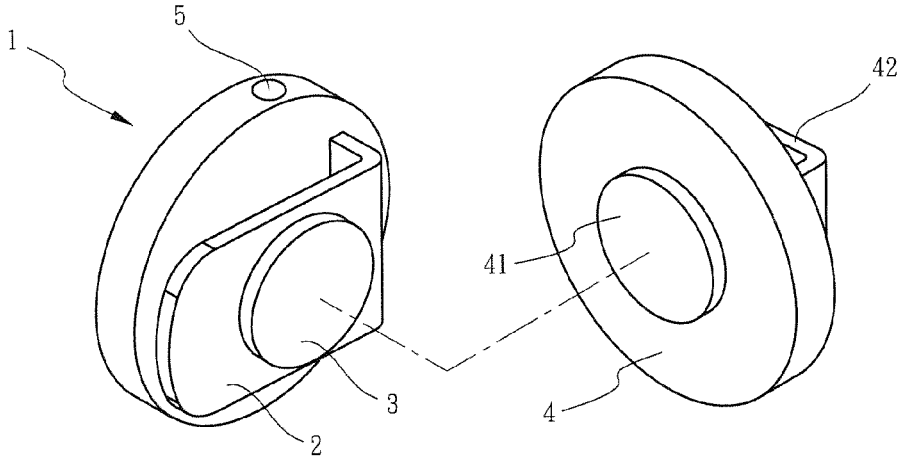
FIG. 3 is a three-dimensional exploded diagram in a different viewing angle of a preferred embodiment of the present invention.
Figure 4:
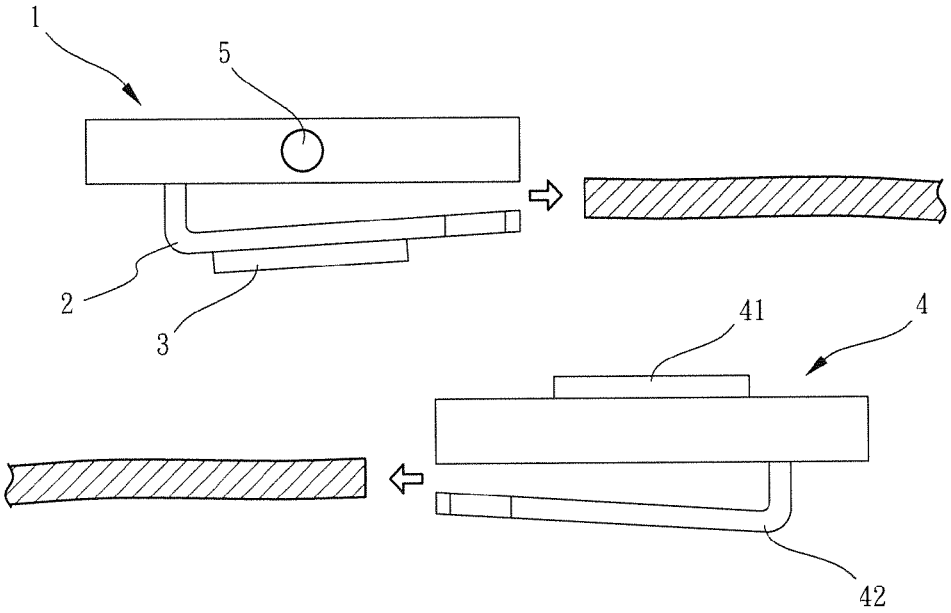
FIG. 4 is an exploded sectional diagram of the main grip body and the subsidiary grip body respectively attached to the clothing of a preferred embodiment of the present invention.

To describe clearly that the present invention achieves the foregoing objective and function, the technical features and desired function are described with reference to a preferred embodiment and accompanying drawings. Reference to FIGS. 1-5, the present invention, a button device, is available to be attached to clothing, comprising: a main grip body 1, shaped preferably a disc in FIG. 2, having a clip member 2 at its one side, where the clip member 2 connects to the main grip body 1 at its one end while the other end is elastically buckled away from or close to the main grip body 1. And the clip member 2 is provided with a joint member 3 on the outer side of the other end without connecting to the main grip body 1; and a subsidiary grip body 4, similar in appearance to the main grip body 1, attaching to the clothing and being buckled with the main grip body 1, where the position of the subsidiary grip body 4 on the clothing is in the same height to that of the main grip body 1. The subsidiary grip body 4 is provided with a coupling member 41 corresponding to the joint member 3 for mutual engagement, and is provided with a latch member 42 on the side opposite to the side with the coupling member 41 where the latch member 42 connects to the subsidiary grip body 4 at its one end while the other end is elastically buckled away from or close to the subsidiary grip body 4. Accordingly, once the main grip body 1 and the subsidiary grip body 4 are attached to the clothing, and the joint member 3 and the coupling member 41 are engaged one with the other, the dressing is then aesthetic and the new button device is functional, which saves time and efforts for the replacement.

Once someone is away from home, there is always lacking of sewing kit, which for sure causes embarrassment for the lost buttons. This invention is applicable to such urgent situation. The main grip body (1) and the subsidiary grip body (4) are attached to the clothing by means of the clip member 2 and the latch member 42 respectively to the two sides of front opening of the clothing, and the assembled positions are in the same height and in mutually correspondence. The clip members 2 and the latch member 42 are in resilient clamping to the clothing. As the two sides of the front opening of the clothing are drawn together and the subsidiary grip body 4 is placed below the main grip body 1, followed by having the coupling member 41 and the joint member 3 buckled one with the other, the dressing is then aesthetic and the new button device is functional.

Aside from the functional replacement of the original button, the main grip body 1 is provided with a display 11 mounting on its outer side, where the display 11 and the clip member 2 are located in opposite side of the main grip body 1, and the main grip body 1 has a built-in database 12 electrically connected to the display 11. And the main grip body 1 has a power supply 13 electrically connected with the display 11. The database 12 is provided with information 121 of plural button patterns, where the display 11 shows the information 121 of corresponding button patterns. As the main grip body 1 and the subsidiary body 4 are engaged one with the other, the information 121 in the database 12 is shown in the display 11, which shows conformity in the appearance of the buttons, shown in FIGS. 3-5.

Figure 5:
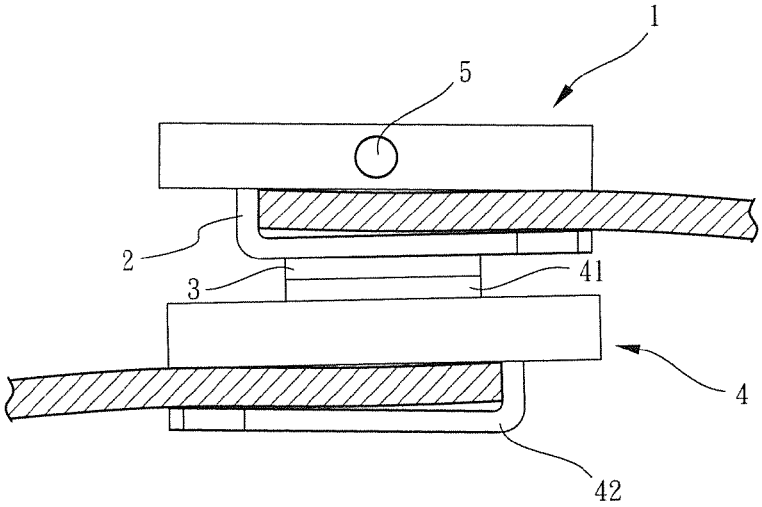
FIG. 5 is a sectional diagram of the main grip body and the subsidiary grip body attached to the clothing and engaged one with the other of a preferred embodiment of the present invention.
Figure 6:
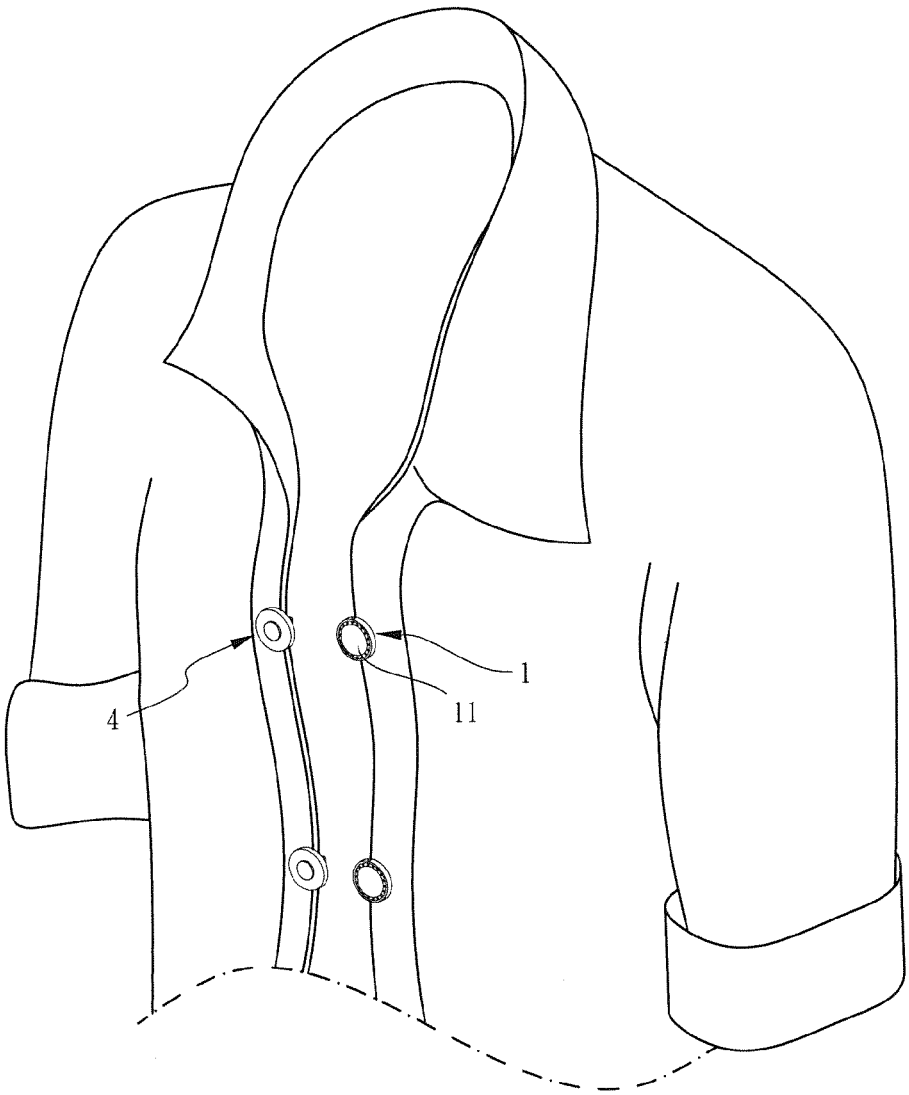
FIG. 6 is a three-dimensional diagram of the main grip body and the subsidiary grip body attached to the clothing of a preferred embodiment of the present invention.
Figure 7:
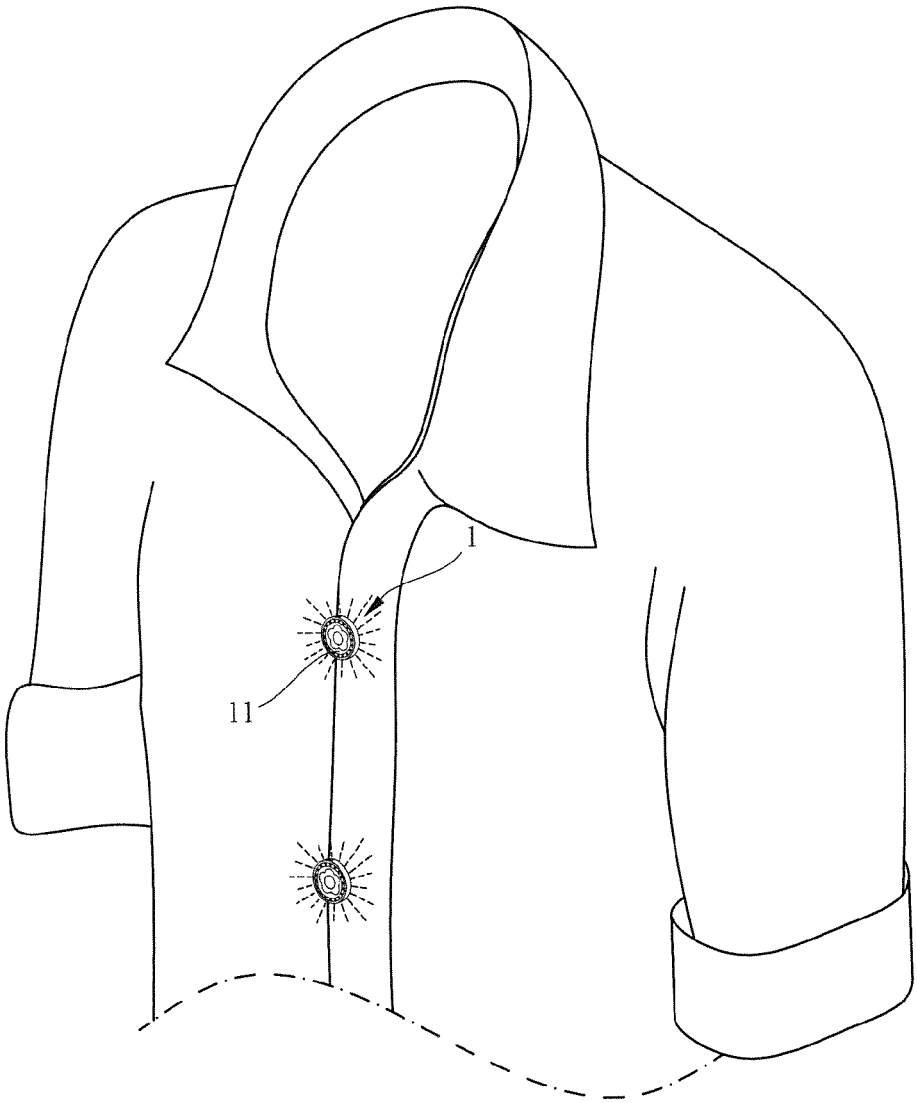
FIG. 7 is a three-dimensional diagram of the main grip body and the subsidiary grip body attached to the clothing where the two borders of the clothing are overlapped one with the other of a preferred embodiment of the present invention.
Figure 8:
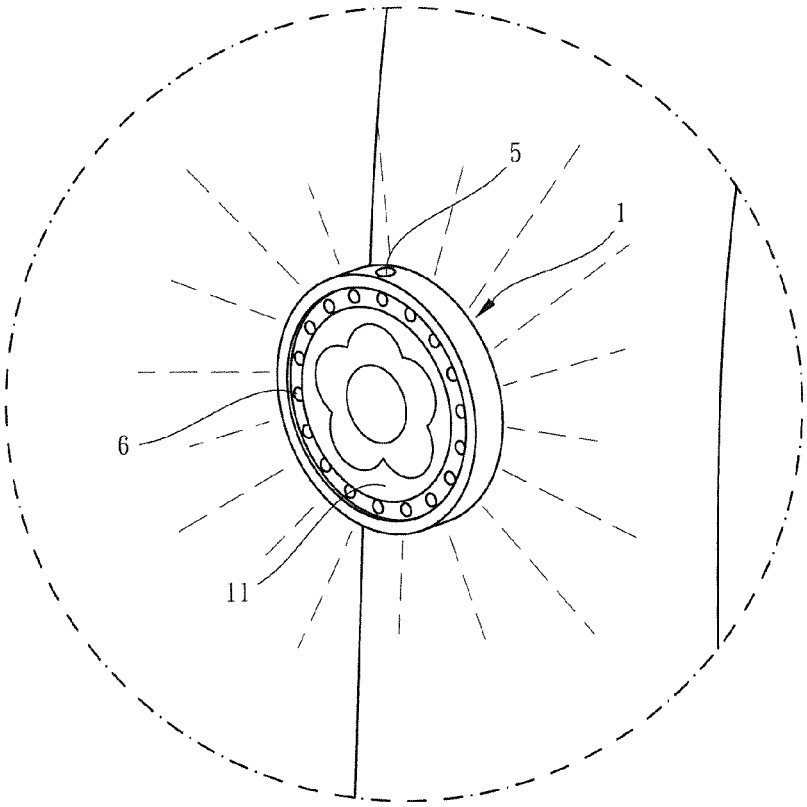
FIG. 8 is an enlarged diagram of FIG. 7.
Figure 9:
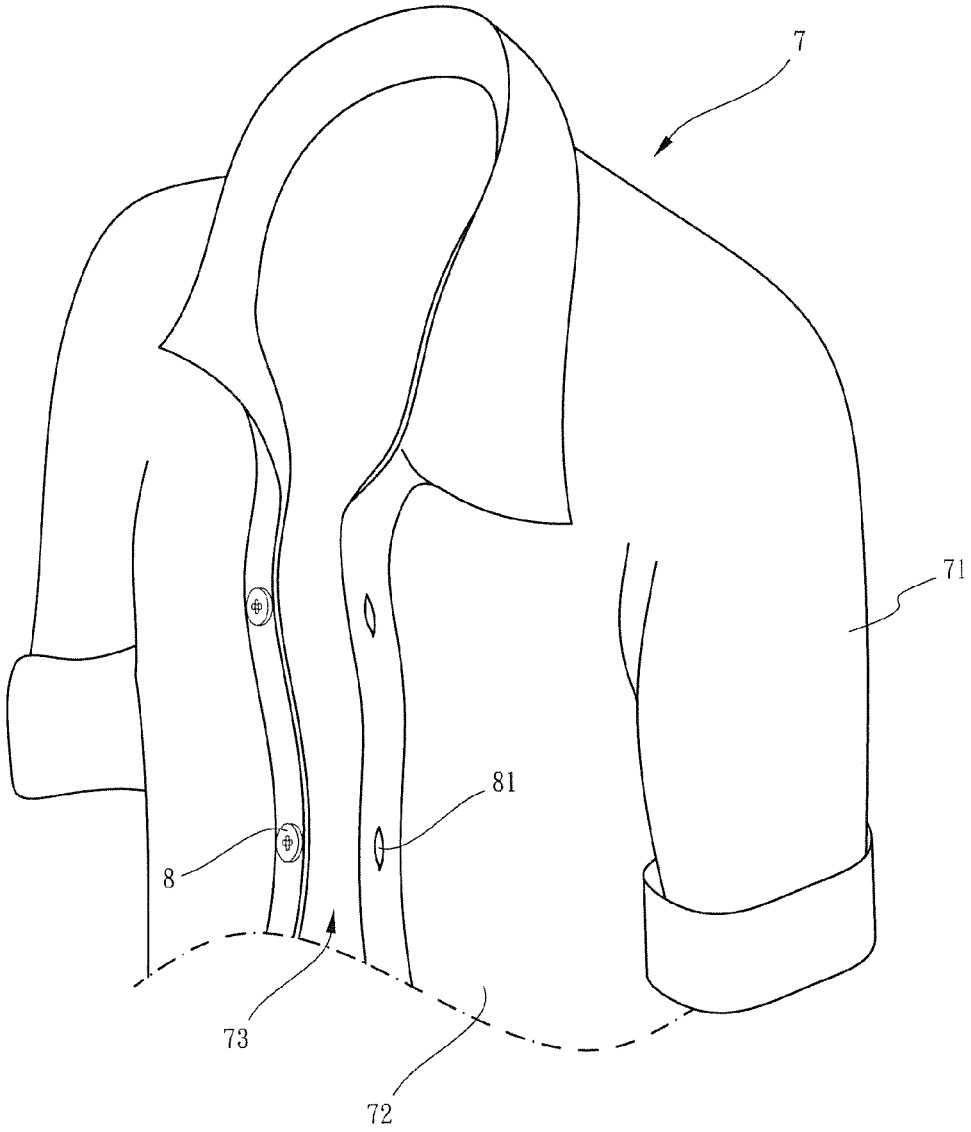
FIG.9 (Prior art)
FIG. 9 is a three-dimensional diagram of a prior shirt.

The joint member 3 of the main grip member 1 and the coupling member 41 of the subsidiary grip member 4 are magnets that one attracts the other, Velcro (hook-and-loop fasteners), male and female buckles or positive and negative electrodes. Reference to FIG. 5, the subsidiary grip body 4 is provided with a power member 43, and the joint member 3 and the coupling member 41 are realized as positive and negative electrodes respectively accompanied by the setup of the power member 43. By way of the electrical coupling for the joint member 3 of the clip member 2 and the coupling member 41 of the subsidiary grip body 4, electric power is available to be transmitted for use by the display 11 Besides, the power supply 13 in the main grip body 1 also supplies power to the display 11, so that the power member 43 in the subsidiary grip body 4 and the power supply of the main grip body take turns to supply power to the display 11, to avoid any possible failure of exhibiting the button patterns.

The present invention is further characterized in that the main grip body 1 is provided with an input member 5 adjacent to one side of the display 11, for a supplement during lacking enough information 121 of button patterns. The input member 5 is disposed adjacent to the display 11 and is electrically connected to the database 12 in wireless or wired connection (the input member 5 can be located on peripheral side or the same side with the display 11, not intend to limit its position). There are some types of embodiments to realize the input member 5. As the input member 5 is a camera, the user takes images of his own button pattern, stores the images in the database 12 and shows the appearance of the images on the display 11 to exhibit conformity in the appearance of the buttons. The input member 5 is available to be a microphone or a CMOS integrated circuit for setting purpose. The microphone features primarily the voice control over the exhibition of the button patterns and the recording (not shown in the figures). The CMOS integrated circuit for setting purpose is to provide users the setting the button pattern beforehand, and controls the button pattern shown on the display 11 (not shown in the figures).

The present invention is further characterized in that the main grip body is provided with a backlight member 6 electrically connected to the power supply member 13 near a side of the display 11, the backlight 6 is made out of plural LEDs or OLEDs, and the backlight member 6 is disposed to surround the display 11 for illuminating and enhancing the button patterns shown by the display. Once the joint member 3 and the coupling member 41 are realized as positive and negative electrodes respectively, the power member 43 of the subsidiary grip body 4 transmits electric power to the backlight member 6. By means of the power supply member 13 and the power member 43, to stabilize the illumination of the backlight member 6, shown in FIG. 5.

The present invention is further characterized in that the clip member 2 and the latch member 42 are L-shape resilient clamp, magnet, crochet, paper clips, clips or earrings, where the buttons are fixed firmly to the clothing with the support of these clamping devices. However, the exemplifications are not intended to limit the kinds of the clamping devices.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A button device, attachable to clothing having buttons, comprising:

a main grip body, having a clip member at a side thereof, where the clip member connects to said main grip body at a first end thereof while a second end is elastically buckled away from or close to said main grip body, and the clip member being provided with a joint member on an outer side of the second end without connecting to said main grip body, said main grip body having a display mounting on an outer side thereof, the display and the clip member located in opposite side of said main grip body, said main grip body having a built-in database electrically connected to the display and a power supply member electrically connected to the display, the database being provided with information of a plurality of button patterns, where the display exhibits the information of button patterns corresponding to real buttons of the clothing; and a subsidiary grip body, attaching to the clothing and being buckled with said main grip body, where the position of said subsidiary grip body on the clothing is in the same height to that of said main grip body, said subsidiary grip body being provided with a coupling member corresponding to the joint member for mutual engagement, and being provided with a latch member on a side opposite to the coupling member, where the latch member connects to said subsidiary grip body at a first end thereof while a second end is elastically buckled away from or close to said subsidiary grip body;

wherein once said main grip body and subsidiary grip body being attached to the clothing, and the joint member and the coupling member being engaged one with the other, the dressing being then aesthetic and the button device being functional, which saves time and efforts for the replacement.

2. The button device as claimed in claim 1 wherein said subsidiary grip body is further provided with a power member, and the joint member and the coupling member are realized as positive and negative electrodes respectively accompanied by a setup of the power member, by way of the electrical coupling for the joint member of the clip member and the coupling member of said subsidiary grip body, electric power being available to be transmitted for use by the display.

3. The button device as claimed in claim 1 wherein said main grip body is further provided with an input member adjacent to a side of the display, and the input member is a camera featuring images taking, the input member being electrically connected to the database, taking shots of the button patterns and storing them in the database for later use.

4. The button device as claimed in claim 3 wherein the input member is a microphone or a CMOS integrated circuit for setting purpose.

5. The button device as claimed in claim 1 wherein said main grip body is provided with a backlight member electrically connected to the power supply member near a side of the display, the backlight member is a LED or an OLED, and the backlight member is for illuminating the button patterns shown by the display.

6. The button device as claimed in claim 1 wherein the joint member and the coupling member are realized as positive and negative electrodes respectively and connected one with the other, and electric power is available to be transmitted for use by the backlight member.

7. The button device as claimed in claim 1 wherein the joint member and the coupling member are selected from the group consisting of magnets that one attracts the other, hook-and-loop fasteners or male and female buckles.

8. The button device as claimed in claim 1 wherein the clip member and the latch member are selected from the group consisting of L-shape resilient clamp, magnets, crochet, paper clips, clips or earrings.

* * * * *